US006983731B2

(12) United States Patent
Rohatschek et al.

(10) Patent No.: US 6,983,731 B2
(45) Date of Patent: Jan. 10, 2006

(54) METHOD FOR OPERATING A FUEL INJECTION SYSTEM FOR AN INTERNAL COMBUSTION ENGINE

(75) Inventors: Andreas-Juergen Rohatschek, Wernau/Neckar (DE); Udo Schulz, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/509,971

(22) PCT Filed: Apr. 8, 2003

(86) PCT No.: PCT/DE03/01154

§ 371 (c)(1),
(2), (4) Date: Jun. 7, 2005

(87) PCT Pub. No.: WO03/085247

PCT Pub. Date: Oct. 16, 2003

(65) Prior Publication Data

US 2005/0235965 A1 Oct. 27, 2005

(30) Foreign Application Priority Data

Apr. 9, 2002 (DE) ..... 102 15 609
Mar. 13, 2003 (DE) ..... 103 10 955

(51) Int. Cl.
*F02B 3/00* (2006.01)

(52) U.S. Cl. ..... 123/299; 123/446

(58) Field of Classification Search ..... 123/299, 123/300, 305, 294, 446, 445
See application file for complete search history.

(56) References Cited

U.S. PATENT DOCUMENTS 6,672,278 B2 * 1/2004 Zimmermann et al. ..... 123/299

FOREIGN PATENT DOCUMENTS

DE 100 33 343 1/2002

OTHER PUBLICATIONS

Patent Abstracts of Japan, vol. 1999, No. 11, Sep. 30, 1999 & (JP 11 159414 A (Hitachi Ltd.), Jun. 15, 1999.

* cited by examiner

*Primary Examiner*—Bibhu Mohanty
(74) *Attorney, Agent, or Firm*—Kenyon & Kenyon

(57) ABSTRACT

A method for operating a fuel injection system for an internal combustion engine is provided, in which monitoring is performed as to whether an overlapping occurs between a time interval in which one piezoelectric element for injecting fuel into a cylinder is to be charged or discharged, and a time interval in which a different piezoelectric element for injecting fuel into a different cylinder is to be charged or discharged. The monitoring is performed as to whether, in the context of a lower-priority injection, the charging or discharging occurs within a predefined time interval around the point in time of a charging or discharging of a higher-priority injection, the spacings of time-related charging and/or discharging edges (edge overlaps) being determined during operation of the fuel injection system, and the magnitude of the shift and/or shortening of the lower-priority injections with respect to the higher-priority injections being determined therefrom.

13 Claims, 7 Drawing Sheets

$t_K = B - A$ $t_K = B - A - \varphi_{max}$ $t_K = B - A + \varphi_{max}$

Ex.: $\varphi_{post} = 75°$ $\varphi_{pre} = 125°$ $\varphi_{max} = 720°$

Collision for:

$\varphi_{post} \leq t_K \leq \varphi_{pre}$ $t_K \geq -\varphi_{post}$ $t_K \leq \varphi_{pre}$

METHOD FOR OPERATING A FUEL INJECTION SYSTEM FOR AN INTERNAL COMBUSTION ENGINE

FIELD OF THE INVENTION

The present invention relates to a method for operating a fuel injection system for an internal combustion engine.

BACKGROUND INFORMATION

Published German patent document DE 100 33 343 discloses a fuel injection system for an internal combustion engine, in particular a diesel engine, that includes an injection control system for monitoring and/or for resolving a conflict upon triggering of the actuator elements, in particular a conflict management system for superimposed injection curves of piezoactuators.

With so-called common rail piezoactuators, only one triggering edge can be executed at a time. For reasons of combustion engineering, however, it is necessary to apply the triggering of complementary banks in such a way that injections are superimposed. This is possible, e.g., with the circuit device known from published German patent document DE 100 33 343 for interconnecting piezoelectric elements, when the charging/discharging edges of the piezoelectric elements exhibit no overlap. With overlapping edges, provision is made in the context of the fuel injection system disclosed in, e.g., published German patent document DE 100 33 343, for the triggering action with low priority (hereinafter called the low-priority triggering action) to be shifted or shortened.

It is an object of the present invention to detect and determine edge overlaps, and to determine therefrom the necessary degree of time shifting or shortening out of the overlap region.

SUMMARY

In accordance with the present invention, the above object is achieved, in a method for operating a fuel injection system of the kind described initially, in that the edge overlaps are determined during static and dynamic interrupts of a triggering circuit during operation of the injection system. This determination is accomplished as a function of the rotation speed and crankshaft angle of the internal combustion engine.

In this context, individual edge times are examined in pairs for overlap. Based on the determined edge overlaps, the necessary degree is determined of time shifting or shortening.

Figure 6:
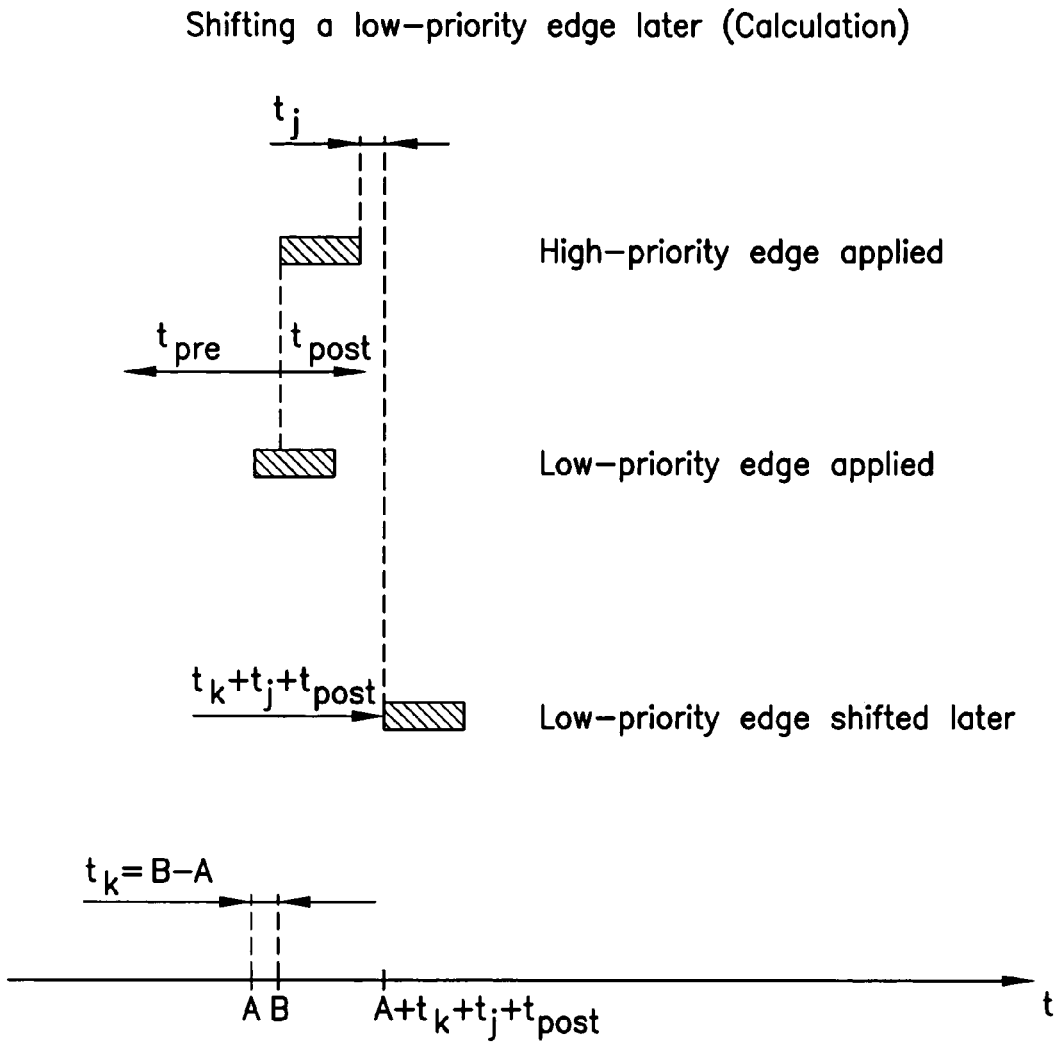

FIG. 6 schematically depicts the shifting of a low-priority edge later in time.

Figure 7:
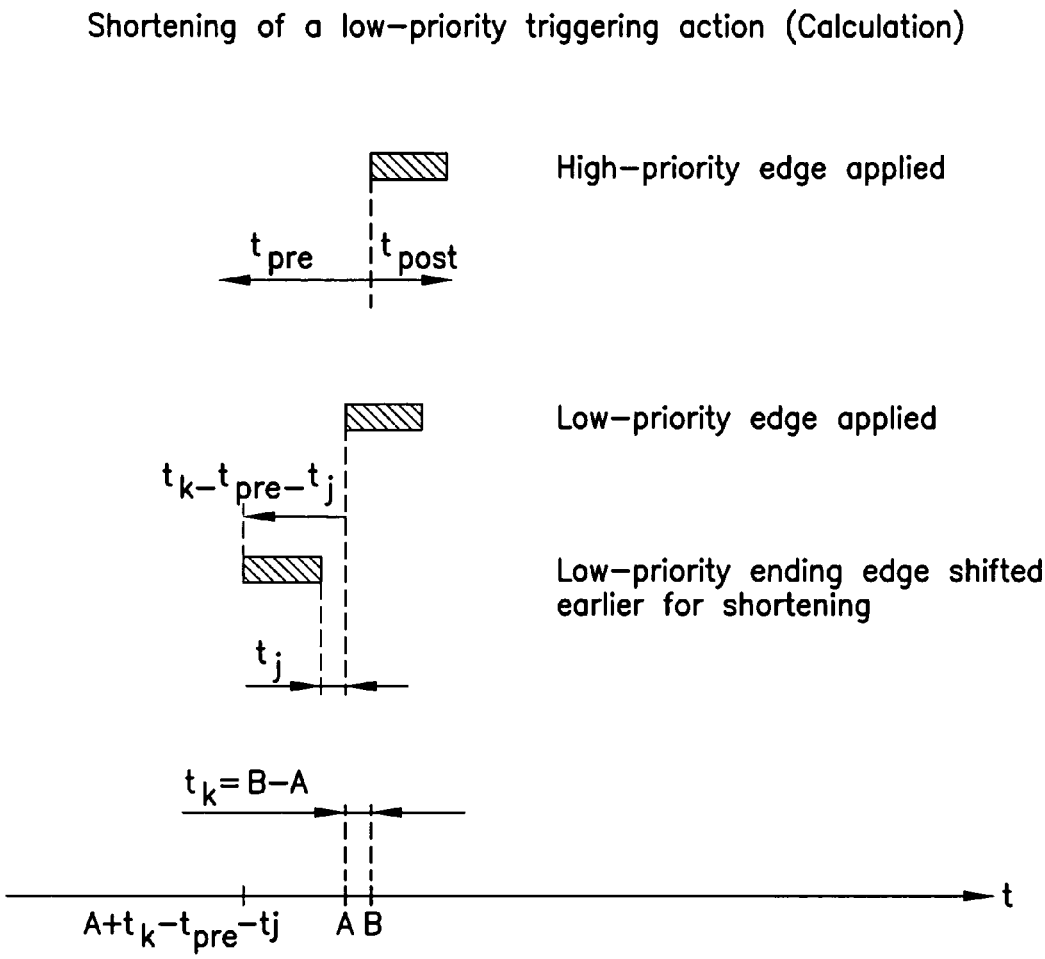

FIG. 7 schematically depicts the shortening of a low-priority triggering action.

DETAILED DESCRIPTION

Figure 1:
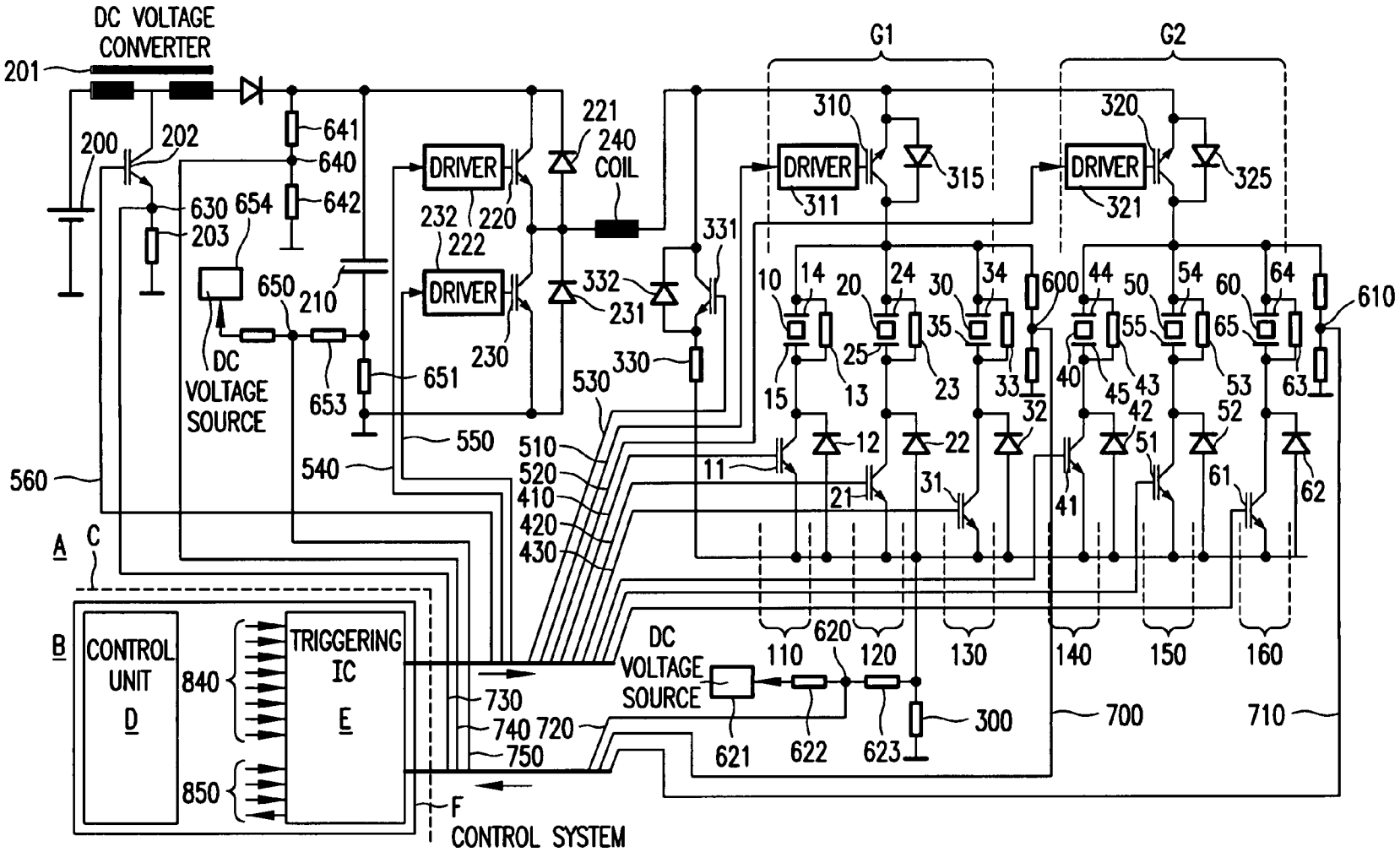
FIG. 1 shows a diagram of an interconnection of piezoelectric elements.

FIG. 1 shows piezoelectric elements 10, 20, 30, 40, 50, 60 as well as circuit arrangements for triggering the piezoelectric elements. The letter A designates a region depicted in detail, and B a region not depicted in detail, the separation of which is indicated by a dashed line c. Region A depicted in detail includes a circuit for charging and discharging piezoelectric elements 10, 20, 30, 40, 50, and 60. In the example shown in FIG. 1, piezoelectric elements 10, 20, 30, 40, 50, and 60 are actuators in fuel injection valves (in particular, in so-called common rail injectors) of an internal combustion engine. In the embodiment described, six piezoelectric elements 10, 20, 30, 40, 50, and 60 are used for independent control of six cylinders within an internal combustion engine; however, any other number of piezoelectric elements could be used for any other desired purposes.

Region B not depicted in detail in FIG. 1 includes an injection control system F having a control unit D and a triggering IC E that serves to control the elements inside region A depicted in detail. Various measured values of voltages and currents are conveyed to triggering IC E from the entirety of the remaining triggering circuit for the piezoelectric elements. According to the present invention, control unit D (e.g., computer) and triggering IC E regulate the triggering voltages and triggering times for the piezoelectric elements. Control computer D and/or triggering IC E also monitor various voltages and currents of the entire triggering circuit for the piezoelectric elements.

In the description below, the individual elements inside region A depicted in detail will be introduced first. A general description of the operations of charging and discharging piezoelectric elements 10, 20, 30, 40, 50, and 60 then follows. Lastly, a detailed description is given of how both operations are controlled and monitored by control computer D and triggering IC E.

Piezoelectric elements 10, 20, 30, 40, 50, and 60 are divided into a first group G1 and a second group G2, each of which encompasses three piezoelectric elements (i.e. piezoelectric elements 10, 20, and 30 in first group G1, and piezoelectric elements 40, 50, and 60 in second group G2). Groups G1 and G2 are constituents of circuit parts connected in parallel. With group selection switches 310, 320, it is possible to define which of groups G1, G2 of piezoelectric elements 10, 20, and 30 or 40, 50, and 60 are respectively discharged by way of a common charging and discharging device (group selection switches 310, 320 are of no importance for charging operations, however, as described in further detail below). Piezoelectric elements 10, 20, and 30 of first group G1 are disposed in one actuator bank, and piezoelectric elements 40, 50, and 60 in second group G2 are disposed in a further actuator bank. The term "actuator bank" designates a block in which two or more actuator elements, e.g., piezoelectric elements, are immovably placed, e.g., encapsulated.

Group selection switches 310, 320 are disposed between a coil 240 and the respective groups G1 and G2 (the coil-side terminals thereof), and the switches are embodied as transistors. Drivers 311, 321, which convert the control signals received from triggering IC E into voltages that are selectable, as necessary, for closing and opening the switches, are implemented.

Diodes 315 and 325 (referred to as group selection diodes) are provided in parallel with group selection switches 310, 320, respectively. If group selection switches 310, 320 are embodied as MOSFETs or IGBTs, these group selection diodes 315 and 325 can be constituted, for example, by the parasitic diodes themselves. During charging operations, group selection switches 310, 320 are bypassed by diodes 315, 325. The functionality of group selection switches 310, 320 is thus reduced to the selection of a group G1, G2 of piezoelectric elements 10, 20, and 30 or 40, 50, and 60 only for the discharging operation.

Within groups G1 and G2, piezoelectric elements 10, 20, and 30, and piezoelectric elements 40, 50, and 60 are disposed respectively as constituents of parallel-connected piezo branches 110, 120, and 130 (group G1), and parallel-connected piezo branches 140, 150, and 160 (group G2). Each piezo branch encompasses a series circuit made up of a first parallel circuit having a piezoelectric element 10, 20, 30, 40, 50, or 60 and a resistor (called a branch resistor) 13, 23, 33, 43, 53, or 63; and a second parallel circuit having a selection switch (called a branch selection switch) embodied as a transistor 11, 21, 31, 41, 51, or 61, and a diode (called a branch diode) 12, 22, 32, 42, 52, or 62.

Branch resistors 13, 23, 33, 43, 53, and 63 cause the respectively corresponding piezoelectric elements 10, 20, 30, 40, 50, and 60 to discharge continuously during and after a charging operation, since they respectively interconnect two terminals of the capacitative piezoelectric elements 10, 20, 30, 40, 50, and 60. Branch resistors 13, 23, 33, 43, 53, 63 are of sufficient size, however, to make this operation slow with respect to the controlled charging and discharging operations, as described below. The charging of any piezoelectric element 10, 20, 30, 40, 50, 60 within a relevant time after a charging operation is therefore to be regarded as invariable.

The branch selection switch/branch diode pairs in the individual piezo branches 110, 120, 130, 140, 150, 160—i.e. selection switch 11 and diode 12 in piezo branch 110, selection switch 21 and diode 22 in piezo branch 120, etc.—can be embodied as electronic switches (i.e. transistors) having parasitic diodes, for example MOSFETs or IGBTs (as indicated above for the group selection switches/diode pairs 310 and 315, and 320 and 325).

With the aid of branch selection switches 11, 21, 31, 41, 51, 61, it is possible to define which of piezoelectric elements 10, 20, 30, 40, 50, 60 are respectively charged by way of a common charging and discharging device; the piezoelectric elements 10, 20, 30, 40, 50, and/or 60 charged in each case are all those whose branch selection switches 11, 21, 31, 41, 51, and/or 61 are closed during the charging operation (described below). Usually only one of the branch selection switches is closed at a time.

Branch diodes 12, 22, 32, 42, 52, and 62 serve to bypass branch selection switches 11, 21, 31, 41, 51, and 61 during discharging operations. In the example considered, each individual piezoelectric element can therefore be selected for charging operations, whereas for discharging operations, either first group G1 or second group G2 of piezoelectric elements 10, 20 and 30, or 40, 50, and 60, or both, must be selected.

Returning to piezoelectric elements 10, 20, 30, 40, 50, and 60 themselves, branch selection piezo terminals 15, 25, 35, 45, 55, and 65 can be connected to ground either using branch selection switches 11, 21, 31, 41, 51, and 61, or via the corresponding diodes 12, 22, 32, 42, 52, and 62, and in both cases additionally via resistor 300.

The currents flowing between branch selection piezo terminals 15, 25, 35, 45, 55, and 65 and ground during the charging and discharging of piezoelectric elements 10, 20, 30, 40, 50, and 60 are measured by resistor 300. A knowledge of these currents allows controlled charging and discharging of piezoelectric elements 10, 20, 30, 40, 50, and 60. It is possible, e.g., by closing and opening charging switch 220 and discharging switch 230 as a function of the magnitude of the currents, to adjust the charging current or discharging current to defined average values, and/or to prevent them from exceeding and/or falling below maximum and/or minimum values, respectively.

In the example embodiment, the measurement itself additionally requires a voltage source 621 that supplies a voltage of, for example, 5 VDC, as well as a voltage divider in the form of two resistors 622 and 623. The purpose of this is to protect triggering IC E (which performs the measurements) from negative voltages, which otherwise might occur at measurement point 620 and cannot be handled by triggering IC E. Negative voltages of this kind are modified by addition, using a positive voltage supplied by the aforesaid voltage source 621 and the voltage divider resistors 622 and 623.

The other terminal of the respective piezoelectric element 10, 20, 30, 40, 50, or 60, i.e. the respective group selection piezo terminal 14, 24, 34, 44, 54, or 64, can be connected to the positive pole of a voltage source via group selection switch 310 or 320 or via group selection diode 315 or 325, and via a coil 240 and a parallel circuit made up of a charging switch 220 and a charging diode 221; or alternatively, or additionally, connected to ground via group selection switch 310 or 320, or via diode 315 or 325, and via coil 240 and a parallel circuit made up of a discharging switch 230 and a discharging diode 231. Charging switch 220 and discharging switch 230 are implemented, for example, as transistors that are triggered via drivers 222 and 232, respectively.

The voltage source encompasses a capacitor 210. Capacitor 210 is charged by a battery 200 (for example, a motor vehicle battery) and a downstream DC voltage converter 201. DC voltage converter 201 converts the battery voltage (for example, 12 V) into substantially any other desired DC voltages (for example, 250 V), and charges capacitor 210 to that voltage. Control of DC voltage converter 201 is accomplished via transistor switch 202 and resistor 203, which serves to measure currents picked off at measurement point 630.

For cross-checking purposes, a further current measurement at measurement point 650 is made possible by triggering IC E and by resistors 651, 652, and 653, and, for example, a 5 VDC voltage source 654; a voltage measurement at measurement point 640 is additionally possible by way of triggering IC E and the voltage-dividing resistors 641 and 642.

Lastly, a resistor 330 (referred to as the total discharge resistor), a switch 331 (referred to as the stop switch), and a diode 332 (referred to as the total discharge diode) serve to discharge piezoelectric elements 10, 20, 30, 40, 50, and 60 (if outside the normal operation, they are not discharged by the "normal" discharging operation, as described below). Stop switch 331 may be closed after "normal" discharging operations (cyclical discharging via discharge switch 230), and thereby connects piezoelectric elements 10, 20, 30, 40, 50, and 60 through resistors 330 and 300 to ground. Any residual voltages that might remain in piezoelectric elements 10, 20, 30, 40, 50, and 60 are thus eliminated. Total discharge diode 332 prevents any occurrence of negative voltages at piezoelectric elements 10, 20, 30, 40, 50, and 60, which in some circumstances could be damaged by the negative voltages.

The charging and discharging of all piezoelectric elements 10, 20, 30, 40, 50 and 60, or of a specific piezoelectric element 10, 20, 30, 40, 50, or 60, is accomplished with the aid of a single charging and discharging device common to all the groups and their piezoelectric elements. In the example embodiment, the common charging and discharging device encompasses battery 200, DC voltage converter 201, capacitor 210, charging switch 220, discharging switch 230, charging diode 221, discharging diode 231, and coil 240.

The charging and discharging of each piezoelectric element is accomplished in the same manner, and is explained below with reference to only first piezoelectric element 10 for sale of simplicity.

Figure 2A:
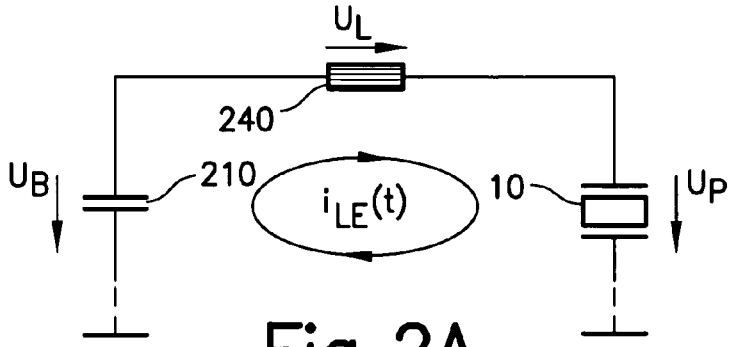
FIG. 2A shows one example of charging of a piezoelectric element.
Figure 2B:
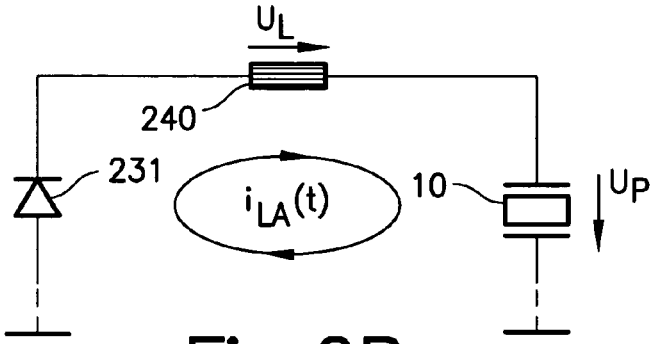
FIG. 2B shows another example of charging of a piezoelectric element.
Figure 2C:
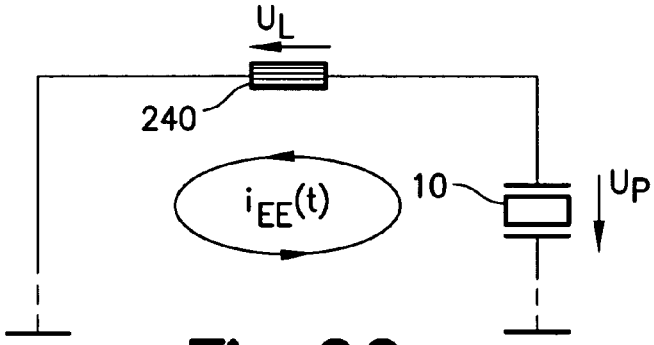
FIG. 2C shows one example of discharging of a piezoelectric element.
Figure 2D:
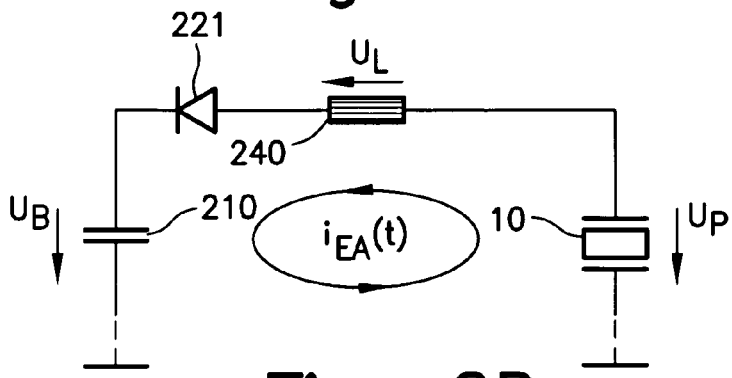
FIG. 2D shows another example of discharging of a piezoelectric element.

The states occurring during the charging and discharging operations are explained with reference to FIGS. 2A through 2D, of which FIGS. 2A and 2B illustrate the charging of piezoelectric element 10, and FIGS. 2C and 2D illustrate the discharging of piezoelectric element 10.

Control of the selection of one or more piezoelectric elements 10, 20, 30, 40, 50, and 60 to be charged or discharged—the charging operation and discharging operation described below—is accomplished by way of triggering IC E and control unit D by the opening and closing of one or more of the aforementioned switches 11, 21, 31, 41, 51, and 61; 310, and 320; 220, 230, and 331. The interactions between the elements inside region A depicted in detail on the one hand, and triggering IC E and control computer D on the other hand, are explained in further detail below.

With respect to the charging operation, firstly a piezoelectric element 10, 20, 30, 40, 50, or 60 to be charged must be selected. To charge only first piezoelectric element 10, branch selection switch 11 of first branch 110 is closed, while all the other branch selection switches 21, 31, 41, 51, and 61 remain open. To charge exclusively any other piezoelectric element 20, 30, 40, 50, or 60, or to charge several elements simultaneously, the appropriate element(s) would be selected by closing the corresponding branch selection switches 21, 31, 41, 51, and/or 61.

The charging operation itself can then occur, as explained below:

For the example embodiment considered, a positive potential difference between capacitor 210 and group selection piezo terminal 14 of first piezoelectric element 10 is generally necessary for the charging operation. As long as charging switch 220 and discharging switch 230 are open, however, no charging or discharging of piezoelectric element 10 takes place. In this situation, the circuit depicted in FIG. 1 is in a steady state, i.e., piezoelectric element 10 retains its charge state with substantially no change, and no currents flow.

To charge first piezoelectric element 10, switch 220 is closed. Theoretically, first piezoelectric element 10 could be charged by that action alone. This would result in large currents, however, which might damage the elements in question. The currents occurring at measurement point 620 are therefore measured, and switch 220 is opened again as soon as the sensed currents exceed a certain limit value. To achieve a desired charge on first piezoelectric element 10, charging switch 220 is therefore repeatedly closed and opened, while discharging switch 230 remains open.

Upon closer examination, the conditions occurring with charging switch 220 closed are those depicted in FIG. 2A, i.e., a closed circuit is created encompassing a series circuit made up of piezoelectric element 10, capacitor 210, and coil 240, and a current iLE(t) flows in the circuit, as indicated in FIG. 2A by arrows. As a result of this current flow, positive charges are conveyed to group selection piezo terminal 14 of first piezoelectric element 10, and energy is stored in coil 240.

If charging switch 220 is opened shortly (for example, a few microseconds) after closing, the conditions depicted in FIG. 2B result: a closed circuit is created encompassing a series circuit made up of piezoelectric element 10, discharging diode 231, and coil 240, and a current iLA(t) flows in the circuit, as indicated in FIG. 2B by arrows. As a result of this current flow, energy stored in coil 240 flows into piezoelectric element 10. Corresponding to the energy delivery to piezoelectric element 10, the voltage occurring in the latter rises, and its external dimensions increase. Once energy has been transferred from coil 240 to piezoelectric element 10, the steady state of the circuit (depicted in FIG. 1 and already described) is once again attained.

At this point in time or earlier or later (depending on the desired time profile of the charging operation), charging switch 220 is once again closed and opened again, so that the processes described above occur again. Because charging switch 220 is closed and then opened again, the energy stored in piezoelectric element 10 increases (the energy already stored in piezoelectric element 10 and the newly delivered energy are added together), and the voltage occurring at piezoelectric element 10 rises, and its external dimensions become correspondingly greater.

If the aforementioned closing and opening of charging switch 220 are repeated many times, the increase in the voltage occurring at piezoelectric element 10, and the expansion of piezoelectric element 10, take place stepwise.

When charging switch 220 has been closed and opened a defined number of times, and/or when piezoelectric element 10 has achieved the desired charge state, charging of the piezoelectric element is terminated by leaving charging switch 220 open.

With regard to the discharging operation, in the example embodiment, piezoelectric elements 10, 20, 30, 40, 50, and 60 are discharged in groups (G1 and/or G2), as described below:

Firstly, group selection switches 310 and/or 320 of group G1 and/or G2, whose piezoelectric elements are to be discharged, are closed (branch selection switches 11, 21, 31, 41, 51, and 61 have no influence on the selection of piezoelectric elements 10, 20, 30, 40, 50, and 60 for the discharging operation, since in this case they are bypassed by diodes 12, 22, 32, 42, 52, and 62). In order to discharge piezoelectric element 10 as a part of first group G1, first group selection switch 310 is therefore closed.

When discharging switch 230 is closed, the conditions depicted in FIG. 2C occur: a closed circuit is created encompassing a series circuit made up of piezoelectric element 10 and coil 240, and a current iEE(t) flows in the circuit, as indicated in FIG. 2C by arrows. As a result of this current flow, the energy (or at least a portion thereof) stored in the piezoelectric element is transferred into coil 240. Corresponding to the energy transfer from piezoelectric element 10 to coil 240, the voltage occurring at piezoelectric element 10 drops, and its external dimensions become smaller.

When discharging switch 230 is opened shortly (for example, a few microseconds) after being closed, the conditions depicted in FIG. 2D occur: a closed circuit is created, encompassing a series circuit made up of piezoelectric element 10, capacitor 210, charging diode 221, and coil 240, and a current iEA(t) flows in the circuit, as indicated in FIG. 2D by arrows. As a result of this current flow, energy stored in coil 240 is fed back into capacitor 210. Once the energy transfer from coil 240 into capacitor 210 has occurred, the steady state of the circuit (depicted in FIG. 1 and already described) is once again attained.

At this point in time, or earlier or later (depending on the desired time profile of the discharging operation), discharging switch 230 is once again closed and opened again, so that the processes described above occur again. Because discharging switch 230 is closed and then opened again, the energy stored in piezoelectric element 10 decreases again, and the voltage occurring at piezoelectric element 10, and its external dimensions, likewise correspondingly decrease.

If the aforementioned closing and opening of discharging switch 230 are repeated many times, the decrease in the voltage occurring at piezoelectric element 10, and the contraction of piezoelectric element 10, take place stepwise.

When discharging switch 230 has been closed and opened a defined number of times and/or when the piezoelectric element has achieved the desired charge state, discharging of the piezoelectric element is terminated by leaving discharging switch 230 open.

The interaction of triggering IC E and control computer D with the elements inside region A depicted in detail is accomplished by way of control signals that are conveyed from triggering IC E, via branch selection control lines 410, 420, 430, 440, 450, and 460, group selection control lines 510, and 520, stop switch control line 530, charging switch control line 540 and discharging switch control line 550, and control line 560, to elements inside region A depicted in detail. On the other hand, sensor signals are acquired at measurement points 600, 610, 620, 630, 640, and 650 inside region A depicted in detail, and are conveyed to triggering IC E via sensor lines 700, 710, 720, 730, 740, and 750.

In order to select piezoelectric elements 10, 20, 30, 40, 50, and/or 60 for the execution of charging or discharging operations of individual or multiple piezoelectric elements 10, 20, 30, 40, 50, and/or 60 by opening and closing the corresponding switches as described above, voltages are applied or not applied to the transistor bases by the control lines. With the aid the sensor signals, a determination is made of the resulting voltage of piezoelectric elements 10, 20, and 30, or 40, 50, and 60, on the basis of measurement points 600 and 610, respectively, and of the charging and discharging currents on the basis of measurement point 620.

Figure 3:
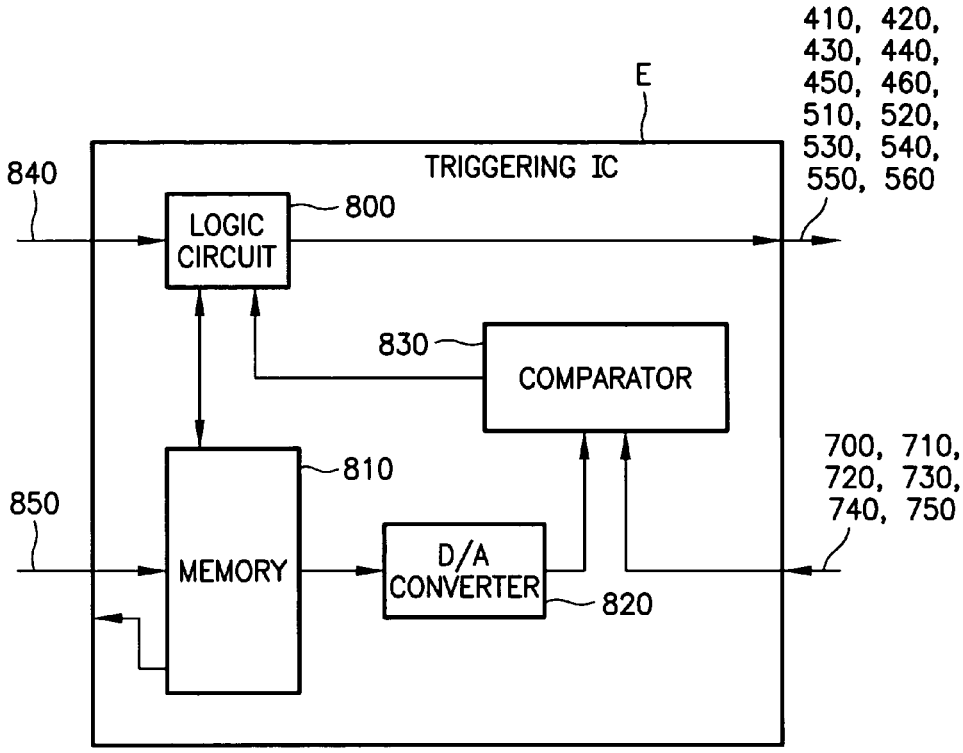
FIG. 3 shows a block diagram of triggering IC.

FIG. 3 indicates some of the components contained in triggering IC E: a logic circuit 800, memory 810, digital/analog converter module 820, and comparator module 830. Also indicated is the fact that the fast parallel bus 840 (used for control signals) is connected to logic circuit 800 of triggering IC E, whereas the slower serial bus 850 is connected to memory 810. Logic circuit 800 is connected to memory 810, to comparator module 830, and to signal lines 410, 420, 430, 440, 450 and 460; 510 and 520; and 530, 540, 550, and 560. Memory 810 is connected to logic circuit 800 and to digital/analog converter module 820. Digital/analog converter module 820 is furthermore connected to comparator module 830. In addition, comparator module 830 is connected to sensor lines 700, 710, 720, 730, 740, and 750, and, as already mentioned, to logic circuit 800.

Figure 4:
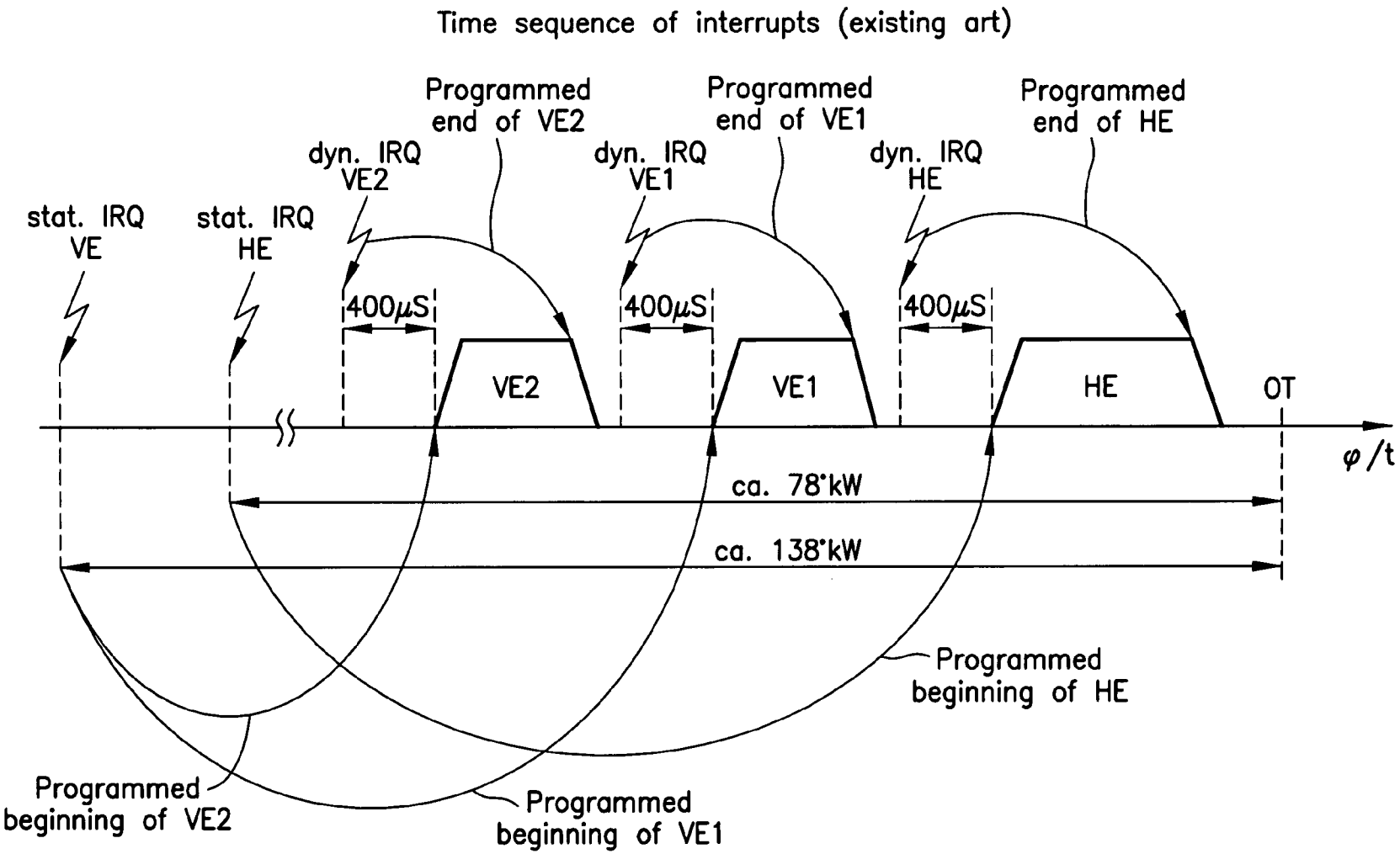
FIG. 4 shows a time sequence of interrupts known in the art.

FIG. 4 schematically shows a time sequence of interrupts for programming the beginning of a main injection HE (to be described below in more detail) and of two preinjections VE1 and VE2, as a function of the top dead center point of the crankshaft. As is evident from FIG. 4, in a six-cylinder engine static interrupts are generated, for example, at approximately 780 crankshaft and, for example, at approximately 138° crankshaft, and these respectively program the beginning of preinjection VE2 and of preinjection VE1 located immediately before main injection HE. The ends of these injections are then programmed on the basis of dynamic interrupts. It is understood that the above crankshaft angles are indicated merely by way of example, and the interrupts may also be generated at different crankshaft angles. Although only the programming of preinjections has been explained above, the same procedure may be used correspondingly for postinjections as well, however, if they are to be performed.

Calculation for the detection of edge overlaps is accomplished in each static and dynamic interrupt. Only overlaps between edges that are known at the time of the interrupt can be calculated.

In each interrupt, the following steps are performed:

1. The current rotation speed n is ascertained; this rotation speed n is used in the entire interrupt (i.e., the rotation speed is "frozen").

2. With each interrupt, new information about edges becomes known. To ensure that only current information items are compared in pairs, the information status is updated. At each interrupt, a flag for new information items is therefore set, and a check is made as to whether triggering operations for which flags are set have already been executed, in which case the relevant flags are deleted.

3. A determination is made of the edge processing times with respect to an arbitrary reference, e.g., with respect to reference time t=0 at a crankshaft angle phi=0°. The known information about beginning angle, time offset, beginning, and duration is utilized, in consideration of the current rotation speed, for extrapolation. The general relationship among rotation speed n, angle phi, and time t is indicated by equation (1):

$$n=(phi/t)*c \quad (1),$$

time being measured in microseconds and crankshaft angle phi in °KW, and constant c being 166,667 (rpm)/(°KW/μs).

4. The individual edge times are examined in pairs for overlap. For example, only pairs belonging to different banks are tested, since overlaps within the same bank result from application errors. The safe strategy, however, is nevertheless to test every conceivable edge pair.

5. A priority is allocated to each injection. A specific priority is assigned to each injection on the basis of system parameters and environmental parameters. As a result, for each injection pairing a distinction is made between low-priority and high-priority triggering actions. Steps are taken to ensure that a switchover of priorities during a calculation run does not have negative consequences. For example, an overlap detection and actions may be performed in the static interrupt in accordance with the current priority constellation, and then the priorities may be switched over, i.e., modified. In the subsequent dynamic interrupt of this pairing, control would need to occur on the basis of a new priority, which would result, in the worst case, in an action against the triggering of a higher-priority injection (high-priority triggering action). Consistent priority allocation must therefore be ensured even in the context of this kind of priority switchover. This may be provided by allocating a priority set to each pairing. The size of the buffer for various priority sets must be selected in such a way that the maximum possible number of changes in the priority sets during the entire execution of a pairing can be stored. After it has been completely processed, the priority set of a pairing is replaced with the current set defined by a priority manager of the electronic triggering circuit.

6. In the overlap examination, the spacing in time between the respective beginnings of the two edges is ascertained. Proceeding from that spacing, a decision can be made as to whether an overlap exists. Since the edge times are based on the angles for the injections, particular attention must be paid here to 720° KW overruns. Purely in principle, a large number of implementation possibilities are conceivable in terms of spacing calculation and evaluation. In the example embodiment of the method described below, three calculations are performed.

Figure 5:
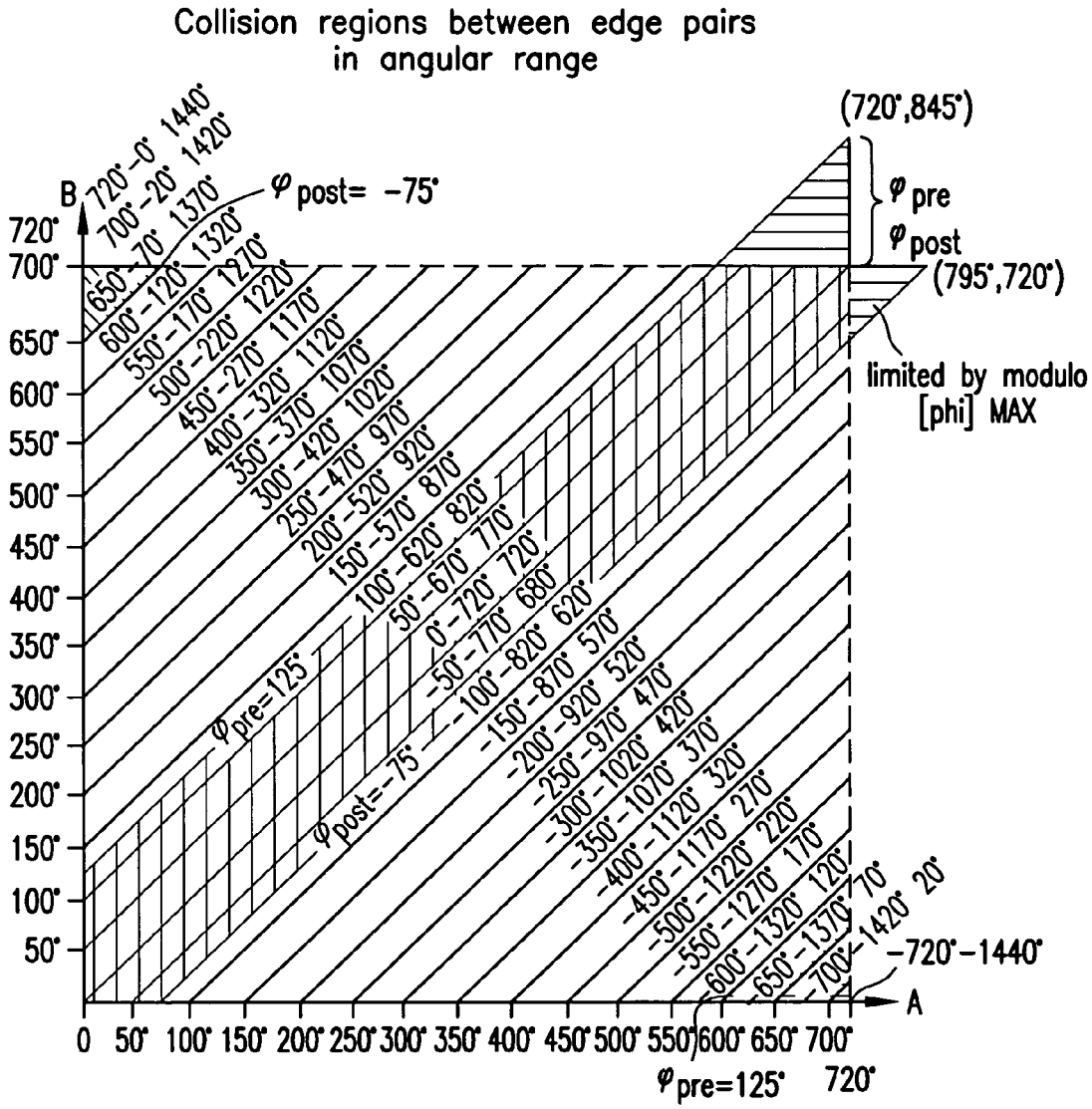
FIG. 5 is a chart plotting low-priority edges versus high-priority edges, which chart shows collision regions of edge pairs in terms of angular region.

FIG. 5 depicts the calculations on the basis of angle, the value of a low-priority edge A being plotted on the abscissa, and the value of a high-priority edge B plotted on the ordinate. The high-priority edge is "protected" with regions on the earlier (pre) and later (post) sides. If a low-priority edge intersects that region, an overlap exists. The regions are marked in the illustration. Regions outside 720° KW= phimax are transferred, in accordance with allocation, into the permissible regions. The results of the calculations using the following equations:

$$B - A \tag{2}$$

$$B - A - phi_{max} \tag{3}$$

$$B - A + phi_{max} \tag{4}$$

are marked in the diagram in FIG. 5. Overlaps that are detected by the individual calculations are characterized in each case by the same crosshatching. The angle-based correlation is explained in FIG. 5; transformation into the time region is accomplished using equation (1) explained above. An example using A=50° and B=100° yields, with equation (2), the overlap for given values of earlier (pre) and later (post) shifting.

7. The degree of shift or shortening is ascertained as a function of the degree of overlap. Shifting is performed in the later direction in such a way that the low-priority beginning edge is placed after the predicted end of the high-priority edge at a distance equal to a time lead. The duration is retained upon shifting. The point in time of the dynamic interrupt, which is coupled to the beginning edge at a fixed spacing, is also shifted. Shortening occurs in such a way that the low-priority ending edge is shifted in the earlier direction. The point in time of the beginning edge is retained. The decision as to whether to shift or shorten depends on whether the beginning edge has already been processed at the moment the overlap is detected. If the beginning edge (this being understood as the beginning of execution of the combustion operation) has already been processed, a shift is no longer possible and only shortening can occur. The result is that for all overlaps of low-priority ending edges, only shortening is possible, since the point in time at which the overlap is detected can lie only in the dynamic interrupt of the low-priority injection, but the latter is associated with execution of the beginning edge.

As an example, a shift is depicted in conjunction with FIG. 6. The overlap is detected using equation (2); the resulting overlap magnitude $t_k$ is incorporated directly into the degree of overlap. The degree of shift is expressed by expression (5) below:

$$t_k + \text{time lead} + \text{"post" protection region} \tag{5}.$$

Expression (5) applies even when the overlap was ascertained from equation (3) or equation (4).

An example of a shortening of the triggering duration is depicted in FIG. 6. The overlap is once again detected using equation (2); the resulting overlap magnitude tk is incorporated directly into the degree of overlap. The degree of shortening is expressed by expression (6) below:

$$t_k - \text{time lead} - \text{"pre" protection region} \tag{6}.$$

Expression (6) applies even when the overlap was ascertained from equation (3) or equation (4).

In addition to primary overlaps or collisions, secondary overlaps or collisions are also possible. Secondary collisions result, for example, when the low-priority beginning edge is shifted later in the static interrupt, but collides with the high-priority ending edge. The point in time at which the collision is detected then lies within the dynamic interrupt of the high-priority triggering action. With this secondary collision, the low-priority beginning edge must therefore be shifted further in the later direction. The procedure is analogous in the case of tertiary overlap or collisions. An example embodiment of the method provides that after a checking of all pairings that has ended with the detection of an overlap and associated action, another pass through all pairings is performed until either an abort criterion based on number of passes occurs, or an absence of overlaps is identified.

In another embodiment of the method, detection is performed of undesired overlappings between the time intervals in which one piezoelectric element is to be charged or discharged and a time interval in which the other piezoelectric element is to be charged or discharged, by calculating the utilized angle ranges and comparing them to predefined permissible angle ranges, i.e., collision-free or collision-tolerant angle ranges.

A "collision-free angle range" is understood as the angle range that can be covered by the various injection types of a cylinder of the internal combustion engine without causing overlaps of triggering actions of the actuators. In the case of a four-cylinder internal combustion engine with a single-bank structure, for example, the collision-free angle range is determined by dividing the 720° crankshaft angle value by the number of cylinders, i.e., four. In an internal combustion engine of this kind, the collision-free angle range is therefore 180° crankshaft angle. The "utilized angle range" is the term for the crankshaft angle range covered from the beginning of the earliest preinjection to the end of the latest postinjection. If the utilized angle range exceeds the collision-free angle region then, for example, a late injection for one cylinder overlaps an early injection for another cylinder in the same bank. As already mentioned earlier, only one actuator in a bank can be charged at one time; otherwise a charge equalization would occur that might cause disruptions in triggering.

In addition to the single-bank structure, several cylinders can also be grouped into a bank, several banks being triggered by the same supply unit for charging and discharging. A configuration of this kind is called a "quasi-multi-bank" structure. In this case, the angle range in which collisions of triggering actions in different banks can be resolved by an edge management system is called the "collision-tolerant" region. In this case, an exceedance beyond the collision-tolerant range plus collision-free angle range results in disrupted triggering actions.

Taking the example of a six-cylinder internal combustion engine with a quasi-double-bank structure, the collision-free angle range is 120° crankshaft angle, and the collision-tolerant angle range is likewise 120° crankshaft angle. The entire permissible angle range is then determined by the sum of the collision-free angle range and the collision-tolerant angle range; in the case of the six-cylinder internal combustion engine with a quasi-double-bank structure, the permissible angle range is 240° crankshaft angle. In general, the permissible angle region in an internal combustion engine having a quasi-double-bank structure can be determined by dividing the value of 720° crankshaft angle by the number of cylinders multiplied by the number of banks.

A main feature of the above embodiment of the method for operating a fuel injection system for an internal combustion engine is calculation of the utilized angle range and comparison with the permissible angle range, i.e., the collision-free angle range or the sum of the collision-free and collision-tolerant angle ranges.

An example embodiment of the method is described below.

In each interrupt, new information items that are used to calculate the utilized angle range become known. In each interrupt, the following steps are performed:

1. The current rotation speed n is ascertained; this rotation speed n is used in the entire interrupt (i.e., the rotation speed is "frozen").

2. With each interrupt, new information about edges becomes known. That information is converted, using the current rotation speed n, to an angular basis.

3. Each newly arrived angle information item is incorporated into the calculation of the utilized angle range. From the set of known angle information items a minimum/maximum selection is made, with the goal of ascertaining the earliest and latest triggering edge belonging to one working cycle. The known utilized angle range is ascertained by differentiation from the angle information for the earliest and latest triggering edges.

After the dynamic interrupt of the last postinjection, the entire utilized angle range from the earliest preinjection to the latest postinjection is therefore known, the general relationship among rotation speed n, angle phi, and time t having already been explained above in the form of equation (1).

4. The known utilized angle range is compared with the predefined collision-free and collision-tolerant angle ranges.

If the ranges are exceeded, an error message is issued and the range exceedance is quantified.

5. In all the calculations, consideration is given to rotation speed dynamics with its effect from the time of calculation to the time of execution, i.e., triggering of the actuators.

The possibilities for reacting to an error message include:

a) correspondingly shifting a low-priority injection, so that the utilized angle range once again lies within the permissible region; and b) accounting for the error message and the degree of range exceedance in the context of the next triggering action at the same or a similar operating point.

What is claimed is:

1. A method for operating a fuel injection system for an internal combustion engine having at least one bank of at least two cylinders, the fuel injection system having at least two piezoelectric elements, each cylinder having associated with it at least one respective piezoelectric element for injecting fuel into the cylinder by at least one of charging and discharging the respective piezoelectric element by a supply unit associated with the at least two piezoelectric elements, the method comprising:

monitoring for an occurrence of an overlap between a first time interval in which a first piezoelectric element is to be one of charged and discharged, and a second time interval in which a second piezoelectric element is to be one of charged and discharged, wherein the monitoring for the overlap includes monitoring for an occurrence of at least one of charging and discharging of a lower-priority injection within a predefined time interval around a point in time of at least one of charging and discharging of a higher-priority injection during operation of the fuel injection system; and determining, based on the overlap, a magnitude of at least one of a shift and a shortening of the lower-priority injection with respect to the higher-priority injection.

2. The method as recited in claim 1, wherein injection priorities are predefined, and wherein the predefined injection priorities are maintained for one injection cycle.

3. The method as recited in claim 2, wherein a determination of the overlap is achieved during an interrupt of a triggering circuit during operation of the fuel injection system.

4. The method as recited in claim 3, wherein a determination of the overlap is achieved based on a rotation speed and a crankshaft angle of the internal combustion engine.

5. The method as recited in claim 4, wherein the internal combustion engine has a plurality of banks of cylinders, each bank having at least two cylinders, and wherein the monitoring includes monitoring for an overlap between a first time interval in which a first piezoelectric element associated with a cylinder of a first bank is to be one of charged and discharged, and a second time interval in which a second piezoelectric element associated with a cylinder of a second bank is to be one of charged and discharged.

6. The method as recited in claim 1, wherein a determination of the overlap is achieved during an interrupt of a triggering circuit during operation of the fuel injection system.

7. The method as recited in claim 6, wherein a determination of the overlap is achieved based on a rotation speed and a crankshaft angle of the internal combustion engine.

8. The method as recited in claim 7, wherein the internal combustion engine has a plurality of banks of cylinders, each bank having at least two cylinders, and wherein the monitoring includes monitoring for an overlap between a first time interval in which a first piezoelectric element associated with a cylinder of a first bank is to be one of charged and discharged, and a second time interval in which a second piezoelectric element associated with a cylinder of a second bank is to be one of charged and discharged.

9. A method for operating a fuel injection system for an internal combustion engine having at least one bank of at least two cylinders, the fuel injection system having at least two piezoelectric elements, each cylinder having associated with it at least one respective piezoelectric element for injecting fuel into the cylinder by at least one of charging and discharging the respective piezoelectric element by a supply unit associated with the at least two piezoelectric elements, the method comprising:

monitoring for an occurrence of an overlap between a first time interval in which a first piezoelectric element is to be one of charged and discharged, and a second time interval in which a second piezoelectric element is to be one of charged and discharged, wherein the monitoring for the overlap includes monitoring for an occurrence of a crankshaft angle range from the beginning of the earliest injection to the end of the latest injection that exceeds a predefined permissible angle range; and determining, based on the overlap, a magnitude of at least one of a shift and a shortening of a lower-priority injection with respect to a higher-priority injection.

10. The method as recited in claim 9, wherein in an internal combustion engine having a plurality of cylinders in a single-bank structure, the permissible angle range is determined by dividing 720° crankshaft angle by the number of cylinders.

11. The method as defined in claim 9, wherein in an internal combustion engine having a plurality of banks each having a plurality of cylinders, the plurality of banks being supplied from a common supply unit in order to at least one of charge and discharge piezoelectric elements associated with the cylinders of the banks, the permissible angle range is determined by dividing 720° crankshaft angle by a product of the number of cylinders multiplied by the number of banks.

12. The method as defined in claim 10, wherein the crankshaft angle range from the beginning of the earliest injection to the end of the latest injection is determined by a minimum/maximum selection of angle data for the earliest injection and the latest injection.

13. The method as defined in claim 11, wherein the crankshaft angle range from the beginning of the earliest injection to the end of the latest injection is determined by a minimum/maximum selection of angle data for the earliest injection and the latest injection.

* * * * *